US012409965B2

(12) United States Patent
He et al.

(10) Patent No.: US 12,409,965 B2
(45) Date of Patent: Sep. 9, 2025

(54) TENSIONING MECHANISM

(71) Applicant: TAIZHOU YONGPAI PACK EQUIPMENT CO., LTD., Zhejiang (CN)

(72) Inventors: Yuhua He, Zhejiang (CN); Shuibo Jiang, Zhejiang (CN)

(73) Assignee: ZHEJIANG WEIPAI PACKAGING EQUIPMENT CO., LTD., Taizhou (CN)

( * ) Notice: Subject to any disclaimer, the term of this patent is extended or adjusted under 35 U.S.C. 154(b) by 337 days.

(21) Appl. No.: 18/042,917

(22) PCT Filed: Aug. 12, 2021

(86) PCT No.: PCT/CN2021/112171
§ 371 (c)(1),
(2) Date: Feb. 24, 2023

(87) PCT Pub. No.: WO2022/042315
PCT Pub. Date: Mar. 3, 2022

(65) Prior Publication Data

US 2023/0294859 A1 Sep. 21, 2023

(30) Foreign Application Priority Data

| | | |
|---|---|---|
| Aug. 25, 2020 | (CN) | 202010860740.8 |
| Aug. 25, 2020 | (CN) | 202021798720.4 |
| Nov. 6, 2020 | (CN) | 202011228003.2 |
| Nov. 6, 2020 | (CN) | 202022555482.0 |

(51) Int. Cl.

| | |
|---|---|
| ***B65B 13/22*** | (2006.01) |
| ***B65B 13/02*** | (2006.01) |
| ***B65B 13/18*** | (2006.01) |

(52) U.S. Cl.
CPC ..... *B65B 13/22* (2013.01); *B65B 13/025* (2013.01); *B65B 13/187* (2013.01)

(58) Field of Classification Search
CPC ..... B65B 13/22; B65B 13/025; B65B 13/187
See application file for complete search history.

(56) References Cited

U.S. PATENT DOCUMENTS

2015/0210411 A1* 7/2015 Finzo ..... B65B 13/22 100/32
2016/0107775 A1* 4/2016 Amacker ..... B65B 13/327 100/29

* cited by examiner

*Primary Examiner* — Mohammed S. Alawadi
(74) *Attorney, Agent, or Firm* — Muncy, Geissler, Olds & Lowe, P.C.

(57) ABSTRACT

The present invention provides a tensioning mechanism, which is installed in a portable packaging machine, the tensioning mechanism is provided with a rotation direction control and rotation angle keeping mechanism, a non-return mechanism and a rocker arm, the rotation direction control and rotation angle keeping mechanism being connected to the non-return mechanism and the rocker arm, and the rocker arm being provided with a toothed structure matching the tensioning wheel. The present invention is compact in structure, and is capable of realizing the handleless operation of the portable packaging machine from a tensioned state to a non-tensioned state without operating a handle.

19 Claims, 8 Drawing Sheets

TENSIONING MECHANISM

FIELD OF THE INVENTION

The present invention relates to a tensioning mechanism, particularly to a tensioning mechanism of a portable packaging machine.

BACKGROUND OF THE INVENTION

A portable packaging machine is a portable device that can be easily carried to the relevant work point for bundling items. The tightening mechanism is used to tighten the packing strip after wrapping around the item, and its actuator adopts a tightening wheel. The previous portable packaging machine adopts a structure with a handle, by operating the handle, the portable packaging machine switches from a tensioned state to a non-tensioned state (as a working state of placing or removing the packaging strip), and the operation is not automatic enough.

SUMMARY OF THE INVENTION

An object of the present invention is to provide a tensioning mechanism, which is suitable for being mounted in a portable packaging machine and realizes the handleless operation of the portable packaging machine from a tensioned state to a non-tensioned state. To achieve this object, the present invention adopts the following technical solutions:

A tensioning mechanism, which is installed in a portable packaging machine provided with a tensioning wheel and a tensioning wheel driving electric motor; wherein a gear connecting mechanism is arranged between the driving electric motor and the tensioning wheel, and the tensioning mechanism is also provided with a rotation direction control and rotation angle keeping mechanism, a non-return mechanism and a rocker arm, the rotation direction control and rotation angle keeping mechanism being connected to the non-return mechanism and the rocker arm, and the rocker arm being provided with a toothed structure matching the tensioning wheel, by means of matching the rotation direction control and rotation angle keeping mechanism and a second reset mechanism, the rocker arm is driven to rotate, and the angle after the rocker arm rotates in place is kept, such that the toothed structure and the tensioning wheel are in a tensioned matching state or a loosened state; and by means of matching the rotation direction control and rotation angle keeping mechanism and a first reset mechanism, the non-return mechanism is driven to be in a non-return matching state or released from the non-return matching state, the gear connecting mechanism is connected to the non-return mechanism, and when the non-return mechanism is in the non-return matching state, the tensioning wheel can only be driven to rotate in a single direction and cannot rotate reversely, and the single direction is the direction of rotation to tension a packaging strip.

The rotation direction control and rotation angle keeping mechanism adopts a steering engine. Further, the non-return mechanism comprises a non-return mechanism connecting gear, a ratchet coaxially connected with the non-return mechanism connecting gear and a pawl matching the ratchet, the pawl can be driven by a first connecting gear by means of matching a first connecting structure and a first connecting gear, and the rocker arm can be driven by a second connecting gear by means of matching a second connecting structure and a second connecting gear, and the rotation direction control and rotation angle keeping mechanism drives the first connecting gear and the second connecting gear.

Further, the first connecting gear and the second connecting gear are in mesh connection with rotate synchronously, the second connecting gear is larger than the first connecting gear and has a lower rotational speed than the first connecting gear.

Further, the second connecting structure comprises a driving part driven by the second connecting gear and a rotating connecting part, the rotating connecting part is provided with an acted part matching the active part, and the rotating connecting part is also provided with a structure connected to the rocker arm. The rotating connecting part is further provided with a part connected to the second reset mechanism.

Further, the rotating connecting part is in the shape of a ring, and the rotation center line thereof is collinear with the rotation center line of the tensioning wheel, and the gear connecting structure is provided with a planetary gear reduction mechanism, the ring-shaped rotating connecting piece is mounted on the planetary gear reduction mechanism through a bearing.

Further, the pawl arm is mounted on the shaft of the second connecting gear and can rotate relative to the shaft of the second connecting gear, and the active part and the shaft of the second connecting gear are fixedly connected or in a whole.

Further, the gear connecting mechanism comprises a planetary gear reduction mechanism and a connecting gear between the driving electric motor and the planetary gear reduction mechanism. The planetary gear reduction mechanism can be provided with one or more stages.

Further, a preferred embodiment is: the steering engine and the tensioning wheel driving electric motor are arranged in parallel, the steering engine is located above the side of the tensioning wheel and the tensioning wheel driving electric motor; the steering engine is connected with the first connecting gear through the driving gear, and the first connecting gear is in mesh connection with the second connecting gear, and the second connecting gear is larger than the first connecting gear and has a lower rotational speed than the first connecting gear;

the non-return mechanism comprises a non-return mechanism connecting gear, a ratchet coaxially connected with the non-return mechanism connecting gear and a pawl matching the ratchet, the pawl is connected with the first connecting gear through the first connecting structure, and the rocker arm is connected with the second connecting gear through the second connecting structure;

the second connecting structure comprises a driving part driven by the second connecting gear and a rotating connecting part, the rotating connecting part is provided with an acted part matching the active part, and the rotating connecting part is also provided with a structure connected to the rocker arm;

the rotating connecting part is in the shape of a ring, and the rotation center line thereof is collinear with the rotation center line of the tensioning wheel, and the gear connecting structure is provided with a planetary gear reduction mechanism, the ring-shaped rotating connecting piece is mounted on the planetary gear reduction mechanism through a bearing, the tensioning wheel is provided with a ring gear, and the output gear coaxial with the sun gear of the planetary gear reduction mechanism is connected with the ring gear through a connecting gear;

the non-return mechanism is arranged in front of the planetary gear reduction mechanism;

the non-return mechanism connecting gear is mounted on the shaft of the ratchet through a one-way bearing, when the tensioning mechanism is tightening, the non-return mechanism is in a non-return matching state, in the corresponding tensioning rotation direction of the tensioning wheel, the one-way bearing allows the non-return mechanism connecting gear to rotate relative to the ratchet, and when the tensioning wheel driving electric motor stops rotating, the non-return mechanism connecting gear is prohibited from rotating relative to the ratchet in an opposite direction, and both must rotate together.

Furthermore, the ring gear is coaxially arranged with the sun gear of the planetary gear reduction mechanism; the tensioning wheel and the planetary gear reduction mechanism are arranged close to each other in the axial direction, so as to further reduce the connecting parts and reduce the size of the machine and facilitate the use of the portable packaging machine.

Further, the first gear and the sun gear of the planetary gear reduction mechanism are coaxially connected together to further simplify the connecting structure. Alternatively, the first gear and the sun gear can also be connected via an intermediate gear instead of connected coaxially.

Further, the planetary gear carrier of the planetary gear reduction mechanism and the planetary gear are arranged on the side of the mounting plate facing the driving electric motor, the rotating shaft of the planetary gear carrier of the planetary gear reduction mechanism is connected with the output gear, and the output gear is on the other side of the mounting plate, and the ring gear is on the periphery thereof. A plurality of connecting gears surrounding the output gear are arranged between the output gear and the ring gear, and the connecting gear axis is fixed on the mounting plate.

Further, the connection between the connecting gear and the output gear is a deceleration connection.

Further, the tensioning mechanism is provided with a belt pressing mechanism, and the belt pressing mechanism is arranged on the rocker arm of the portable packaging machine, and the belt pressing mechanism comprises a first elastic mechanism and a belt pressing part, the first elastic mechanism pushes the belt pressing part downward, allows the belt pressing part to retract and provides an elastic force for the belt pressing part to return downward, and the height of the lower end of the belt pressing part is lower than the upper end of the toothed plate arranged at the inner bottom of the rocker arm, which is close to the side of the belt pressing mechanism.

Further, the belt pressing part adopts a rolling element.

Further, the portable packaging machine is provided with a packaging strip limiting structure on the inner side of the rocker arm.

Further, the belt pressing mechanism is provided with a rotatable mounting block, the first elastic mechanism and the belt pressing part are arranged in the mounting block, through the rotation of the mounting block, the belt pressing part is adapted to the lifting of the packaging strip when the belt is tightened at the vacated height, and the mounting block is connected to the second elastic mechanism.

Further, the belt pressing mechanism is provided with a spacer and a connecting screw, the spacer is connected with the mounting block, and the connecting screw connects the mounting block with the rocker arm.

Further, the first elastic mechanism adopts a compression spring, the mounting block is provided with a mounting hole inside, the belt pressing part adopts a steel ball, the compression spring and the steel ball are arranged in the mounting hole, and the lower end orifice of the mounting hole is smaller than the diameter of the steel ball.

Further, the second elastic mechanism adopts a torsion spring, and the torsion spring is sleeved between the spacers and connected between the rocker arm and the mounting block.

Further, the mounting block is provided with a connecting hole, the spacer is provided with a part inserted into the connecting hole, and the connecting screw passes through the connecting hole and the spacer to connect with the rocker arm; the mounting block is provided with a hole orthogonally passing through the connecting hole, the lower part of the connecting hole is used as a mounting hole, the belt pressing part adopts a steel ball, the compression spring and the steel ball are arranged in the mounting hole, the lower end orifice of the mounting hole is smaller than the diameter of the steel ball, and the inserting part of the spacer serves as a supporting part of the compression spring.

Further, the spacer is provided with a portion inserted into the connecting hole and serves as a rotation axis of the mounting block.

Further, a concave area is provided on the outer side of the rocker arm, and the mounting block is correspondingly disposed in the concave area.

Due to the adoption of the technical solutions of the present invention, the present invention is compact in structure and is suitable for being applied to a portable packaging machine, and realizes the handleless operation of the portable packaging machine from a tensioned state to a non-tensioned state without operating a handle. Furthermore, for the tensioning mechanism that uses the exclusive driving electric motor of the tensioning wheel, the worm gear structure is avoided, and meanwhile, the compact assembly relationship of adjacent and concentric inclusion can be realized, and the volume is reduced, such that the planetary gear is suitable for use in the limited and applicable space of the portable packaging machine and the non-return mechanism is configured, which is small in size and is portable for users conveniently, and has low energy consumption.

The present invention will be further described in detail below in conjunction with the accompanying drawings and specific embodiments.

DETAILED DESCRIPTION

Figure 1:
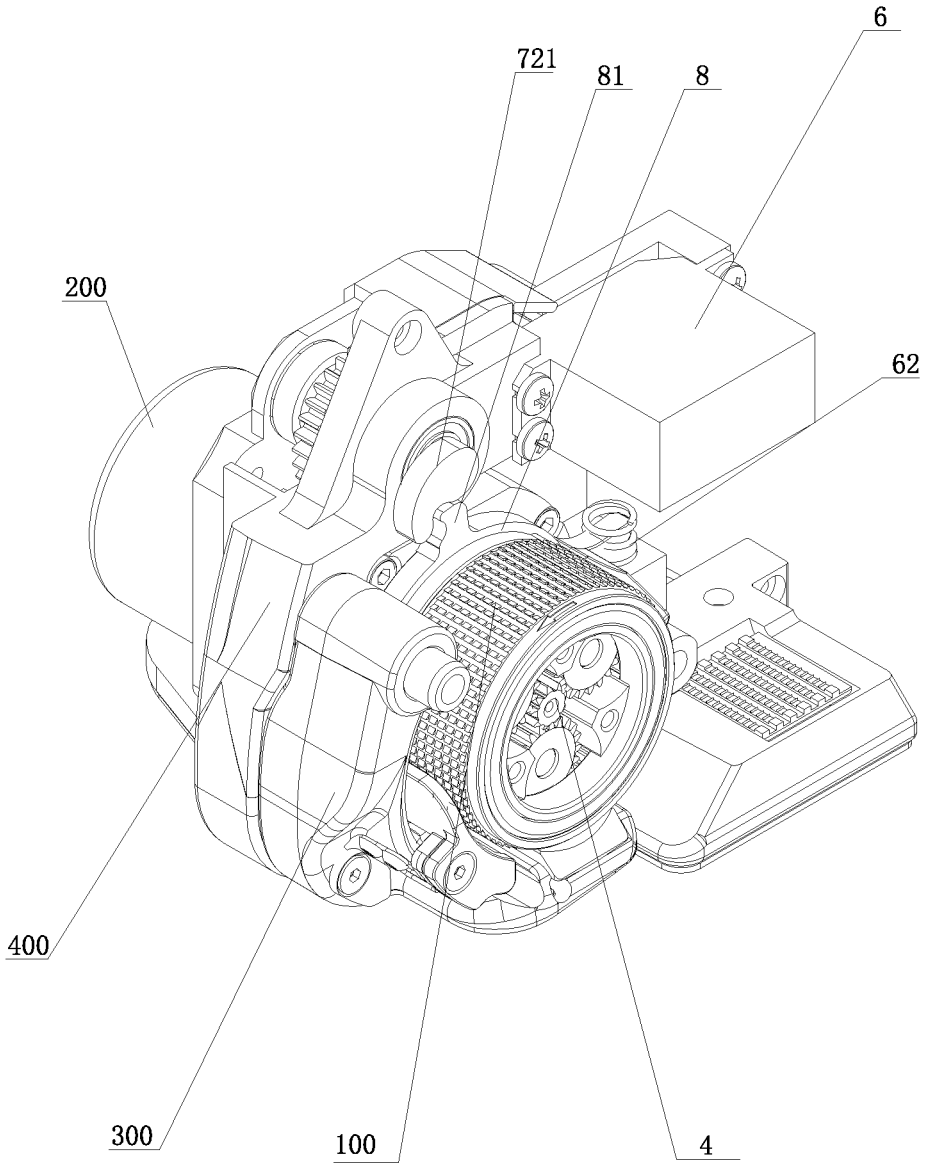
FIG. 1 is a schematic perspective view of an embodiment of the present invention.
Figure 2:
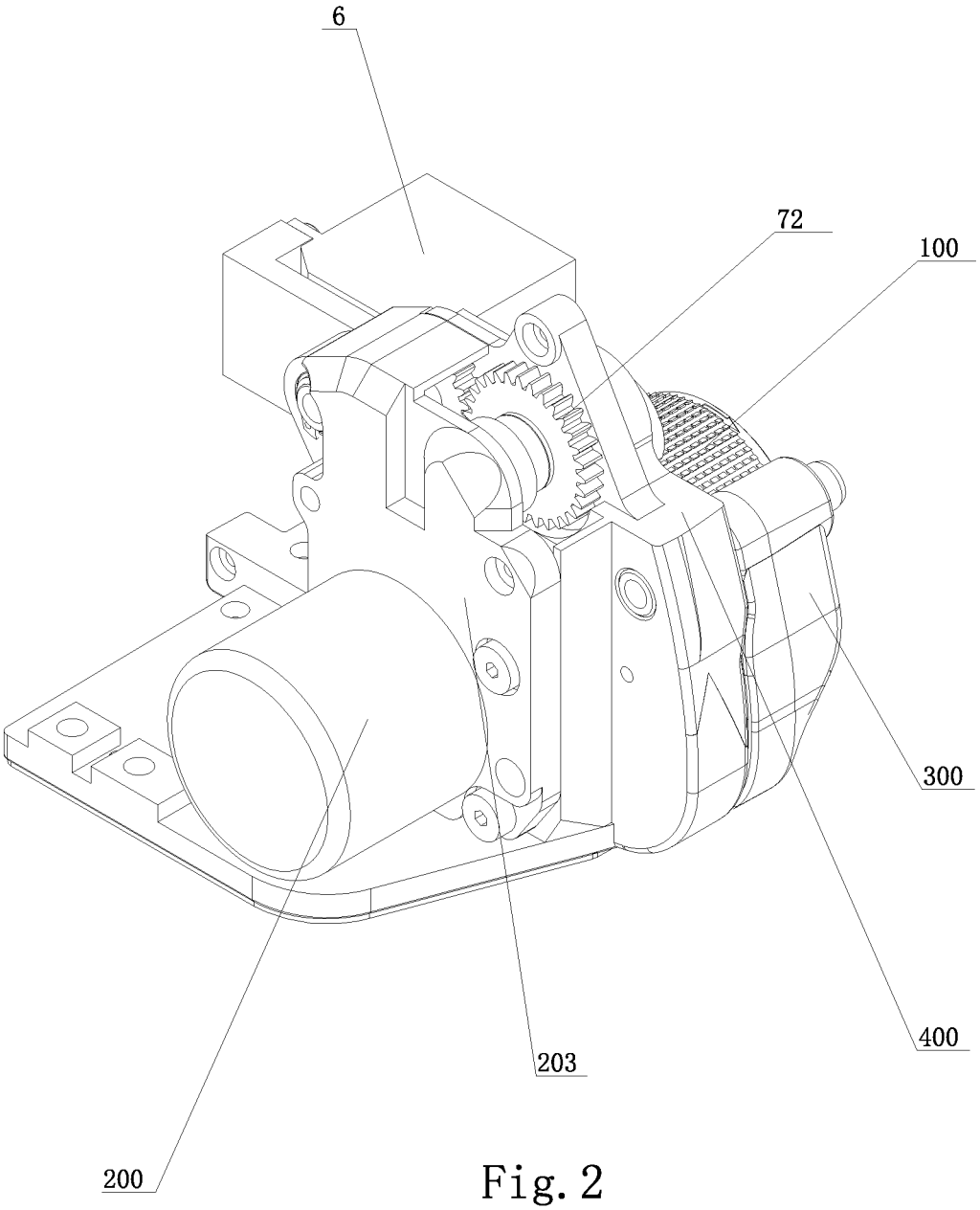
FIG. 2 is a schematic perspective view of another angle of an embodiment of the present invention.
Figure 3:
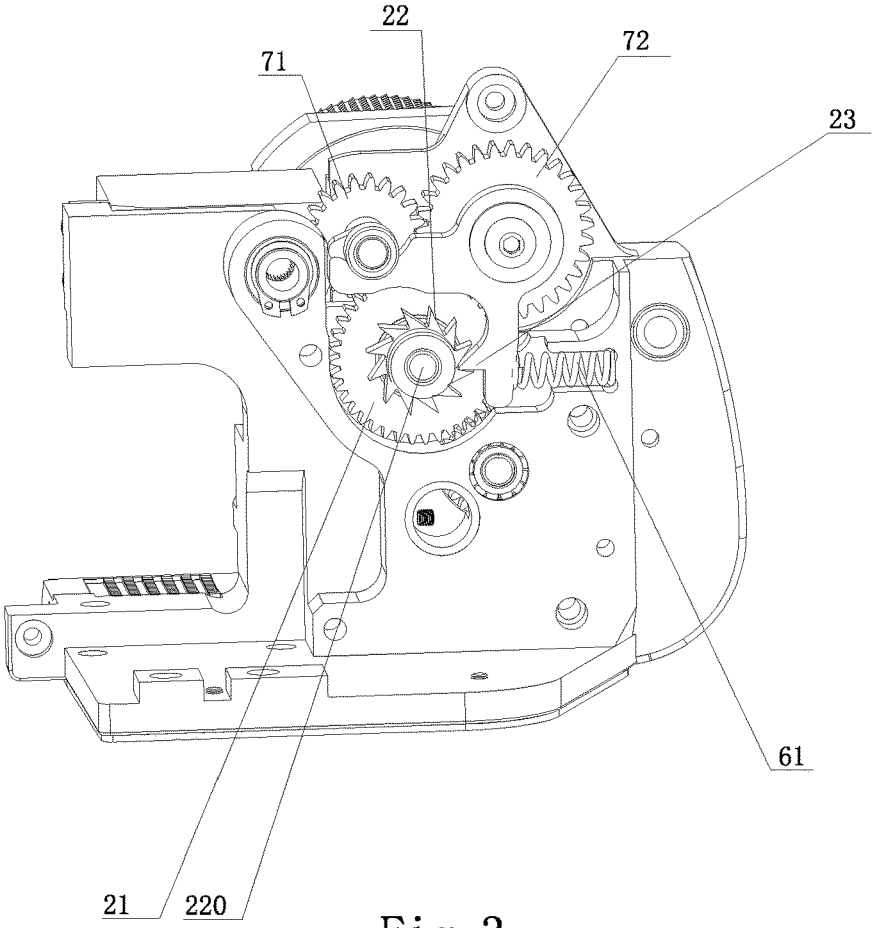
FIG. 3 is a front view of an embodiment of the present invention with the motor mounting base hidden.
Figure 4:
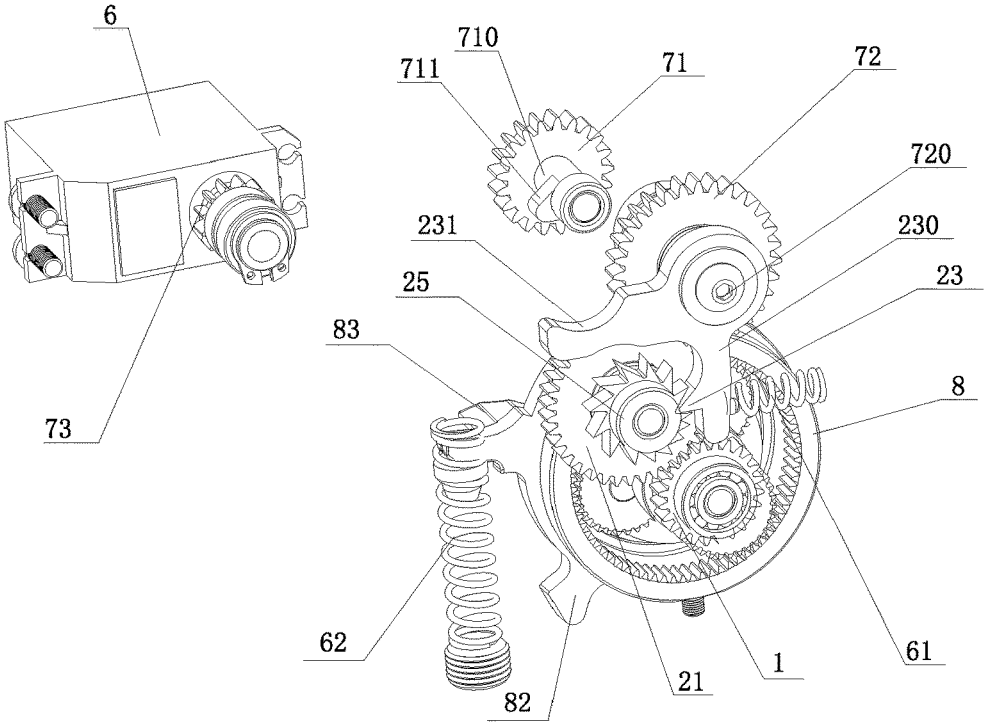
FIG. 4 is an exploded view of a non-return mechanism and surrounding structures thereof.
Figure 5:
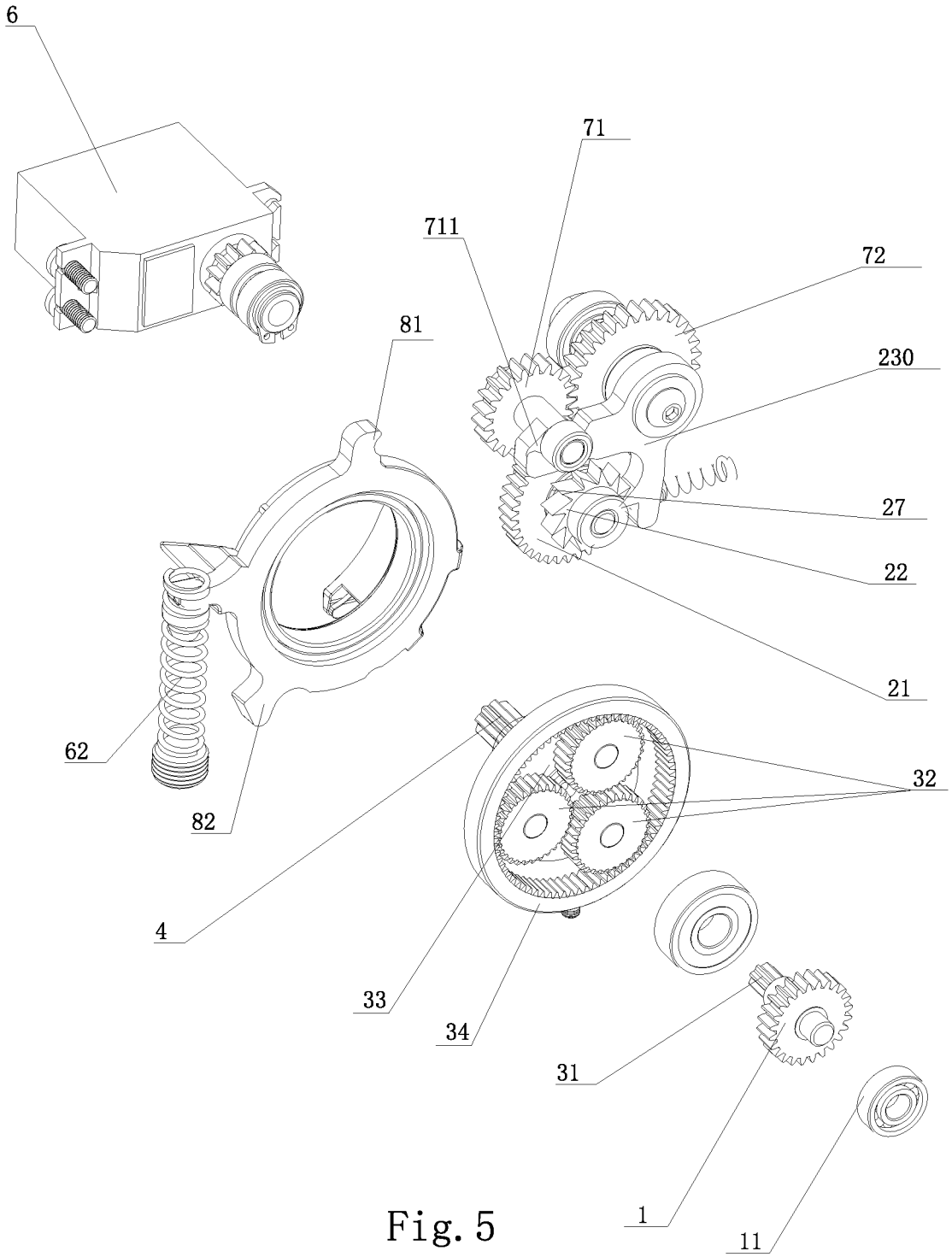
FIG. 5 is an exploded view of a non-return mechanism and a planetary gear mechanism.
Figure 6:
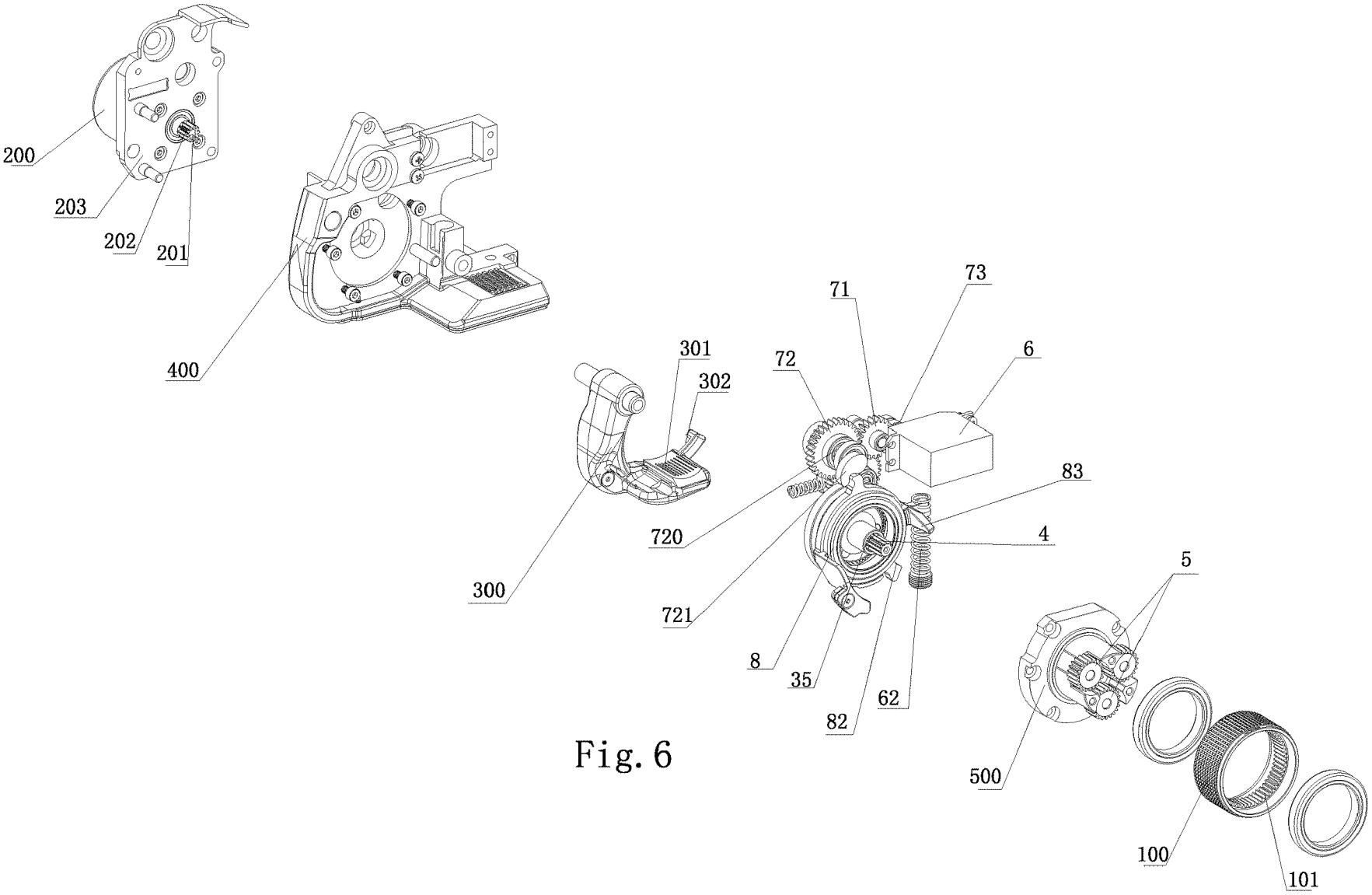
FIG. 6 is an exploded view of an embodiment of a portable packaging machine of the present invention.

Referring to FIGS. 1 to 6, the present invention provides a tensioning mechanism, which is installed in a portable packaging machine. The portable packaging machine is provided with a tensioning wheel 100 and a tensioning wheel driving electric motor 200. The drive motor 200 is mounted on the mounting plate 203 thereof, and the mounting plate 203 is fixedly connected to a mounting base 400. A gear connecting mechanism is arranged between the driving electric motor 200 and the tensioning wheel 100, the gear connecting mechanism comprises a planetary gear reduction mechanism and a connecting gear between the driving electric motor 200 and the planetary gear reduction mechanism.

The tensioning mechanism is also provided with a rotation direction control and rotation angle keeping mechanism, a non-return mechanism and a rocker arm 300, the rotation direction control and rotation angle keeping mechanism can adopts a steering engine 6. The steering engine 6 is connected with the non-return mechanism and the rocker arm 300, the rocker arm 300 is rotatably mounted on the mounting base 400 and is at the periphery of the tensioning wheel 100; the rocker arm 300 is provided with a toothed structure 301 matching the tensioning wheel 100, by means of matching the steering engine 6 and a second reset mechanism, the rocker arm 300 is driven to rotate, and the angle after the rocker arm 300 rotates in place is kept, wherein the second reset mechanism adopts a compression spring 62, such that the toothed structure 301 and the tensioning wheel 100 are in a tensioned matching state or a loosened state; and by means of matching the steering engine 6 and a first reset mechanism, the non-return mechanism is driven to be in a non-return matching state or released from the non-return matching state, wherein the first reset mechanism adopts a compression spring 61, the gear connecting mechanism is connected to the non-return mechanism, and when the non-return mechanism is in the non-return matching state, the tensioning wheel 100 can only be driven to rotate in a single direction and cannot rotate reversely, and the single direction is the direction of rotation to tension a packaging strip.

The non-return mechanism comprises a non-return mechanism connecting gear 21, a ratchet 22 coaxially connected with the non-return mechanism connecting gear 21 and a pawl 23 matching the ratchet, the pawl 23 can be driven by a first connecting gear by means of matching a first connecting structure and a first connecting gear 71, and the rocker arm 300 can be driven by a second connecting gear by means of matching a second connecting structure and a second connecting gear 72.

The steering engine 6 and the tensioning wheel driving electric motor 200 are arranged in parallel, the steering engine 6 is located above the side of the tensioning wheel 100 and the tensioning wheel driving electric motor 200; the steering engine 6 is connected with the first connecting gear 71 through the driving gear 73, and the first connecting gear 71 is in mesh connection with the second connecting gear 72. The axes of the driving gear 73, the first connecting gear 71 and second connecting gear 72 are parallel to the axis of tensioning wheel, the pawl arm 230 is arranged on the shaft 720 of the second connecting gear 72, and can rotate relative to the shaft 720 of second connecting gear 72, the first connecting gear 71 and second connecting gear 72 rotate synchronously. The second connecting gear 72 is larger than the first connecting gear 71 and has a lower rotational speed than the first connecting gear 71, such that the center of gravity of the portable packaging machine is more stable, the action of pawl 23 is more sensitive and the rocker arm 300 has a suitable rotation angle; additionally, the first connecting gear 71 is also larger than the driving gear, and is in a deceleration matching relationship.

The first connecting structure comprises a first cam 711 arranged on the first connecting gear shaft 710 and a second cam 231 arranged on the pawl arm 230, the first cam 711 matches with the second cam 231, and the pawl arm 230 is connected with a reset spring 61. The positive rotation of the steering engine 6 plays a role in driving the pawl to disengage from the ratchet through the matching of the cam. The reset spring 61 is not only used to drive the pawl 23 to reset and form a meshed matching with the ratchet 22, but also to make the second cam 231 lean towards the first cam 711.

The two ends of the shaft 220 of the ratchet 22 are respectively mounted on the mounting plate 203 and the mounting base 400 through the bearings 25. The connecting gear 21 is mounted on the shaft of the ratchet 22 through a one-way bearing 27, and the direction of the one-way bearing 27 is as follows: when the tensioning mechanism is tightening, the connecting gear 21 is allowed to rotate relative to the ratchet 22 driven by the first gear 1, and when the tensioning wheel driving electric motor 200 stops rotating, the connecting gear 21 is prohibited from rotating relative to the ratchet in the opposite direction and both must rotate together.

The second connecting structure comprises a driving part 721 driven by the second connecting gear and a rotating connecting part 8, the rotating connecting part 8 is provided with an acted part 81 matching the active part 721, and the rotating connecting part is also provided with a structure 82 connected to the rocker arm and a part 83 connected to the second reset mechanism. The driving part 721 and the shaft 720 of the second connecting gear 72 are fixedly connected or integrated as a whole, and the forward rotation of the steering engine, through the action of the driving part 721 on the acted part 81, makes the rotating connecting part 8 to rotate, and by means of the structure 82 connected to the rocker arm, the rotation makes the rocker arm 300 to move an angle toward the loosening direction, and the rocker arm 300 can be provided with a bayonet 302 that matches the structure 82. When the steering engine rotates reversely, the driving part 721 rotates in the opposite direction to give way, and through the action of the compression spring 62, the rotating connecting part 8 rotates in the opposite direction, and the rocker arm 300 generates an angle towards the tightening direction, and the toothed structure 301 and tensioning wheel 100 are in a tensioned matching state.

The rotating connecting part 8 is in the shape of a ring, and the rotation center line thereof is collinear with the rotation center line of the tensioning wheel 100, and the ring-shaped rotating connecting part 8 is mounted on the mounting plate 500 of the planetary gear reduction mechanism through the bearing. Since the steering engine 6 is located obliquely above the tensioning wheel 100, and the driving gear 73, the first connecting gear 71 and the second connecting gear 72 are parallel to the axis of the tensioning wheel, the shaft 720 of the second connecting gear 72 is arranged in parallel above the ring-shaped rotating connecting part 8, such that the driving part 721 utilizes the feature that its rotating diameter is smaller than that of the ring-shaped rotating connecting part 8 above the ring-shaped rotating connecting part 8, the rocker arm can rotate a smaller angle, improving the working speed and the precision of the machine.

The tensioning wheel 100 is provided with a ring gear 101, and the output gear 4 coaxial with the sun gear 31 of the planetary gear reduction mechanism is connected with the ring gear 101 through a connecting gear 5; the ring gear 101 is set concentrically with the sun gear 31 of the planetary gear reduction mechanism, and their rotation centers are on the same axis; the tensioning wheel 100 and the planetary gear reduction mechanism are arranged close to each other in the axial direction.

The non-return mechanism is arranged in front of the planetary gear reduction mechanism, and the driving gear 202 is arranged on the output shaft 201 of the driving electric motor 200, and the driving gear 202 is in mesh connection with a first gear 1 in a deceleration connection relationship; the first gear 1 is just in front of the planetary gear reduction mechanism, the first gear 1 is connected with the planetary gear reduction mechanism, and the first gear 1 is also in transmission connection with the non-return mechanism (mesh connection with the connecting gear 21).

The shafts of the first gear 1 and the sun gear 31 of the planetary gear reduction mechanism are the same shaft or integrated as whole, and the shaft is mounted on the mounting base 400 through the bearing 11.

The present invention also provides an embodiment of a reduction mechanism with a simple structure and a small volume for easy assembly. The planetary gear reduction mechanism comprises the sun gear 31, three planetary gears 32, a planetary gear carrier 33 and an annulus 34. The annulus 34 is arranged on the mounting plate 500, the mounting plate 500 is fixed on the mounting base 400, wherein the gear shafts of the three planetary gears 32 are mounted on the planetary gear carrier 33, and the rotating shaft 35 of the planetary gear carrier 33 passes through the mounting hole on the mounting plate 500 and is rotatably mounted on the mounting plate 500. The planetary gear carrier 33 and the planetary gear 32 are arranged on the side of the mounting plate 500 facing the driving electric motor 200, the rotating shaft 35 of the planetary gear carrier 33 of the planetary gear reduction mechanism is connected with the output gear 4, and the output gear 4 is on the other side of the mounting plate 500, the ring gear 101 is on the periphery of the output gear 4, and there are multiple connecting gears 5 around the output gear 4. The axis of the connecting gear 5 is fixed on the mounting plate 500, and the number of connecting gears 5 is generally three. The connection between the connecting gear 5 and the output gear 4 is also a deceleration connection.

Figure 7:
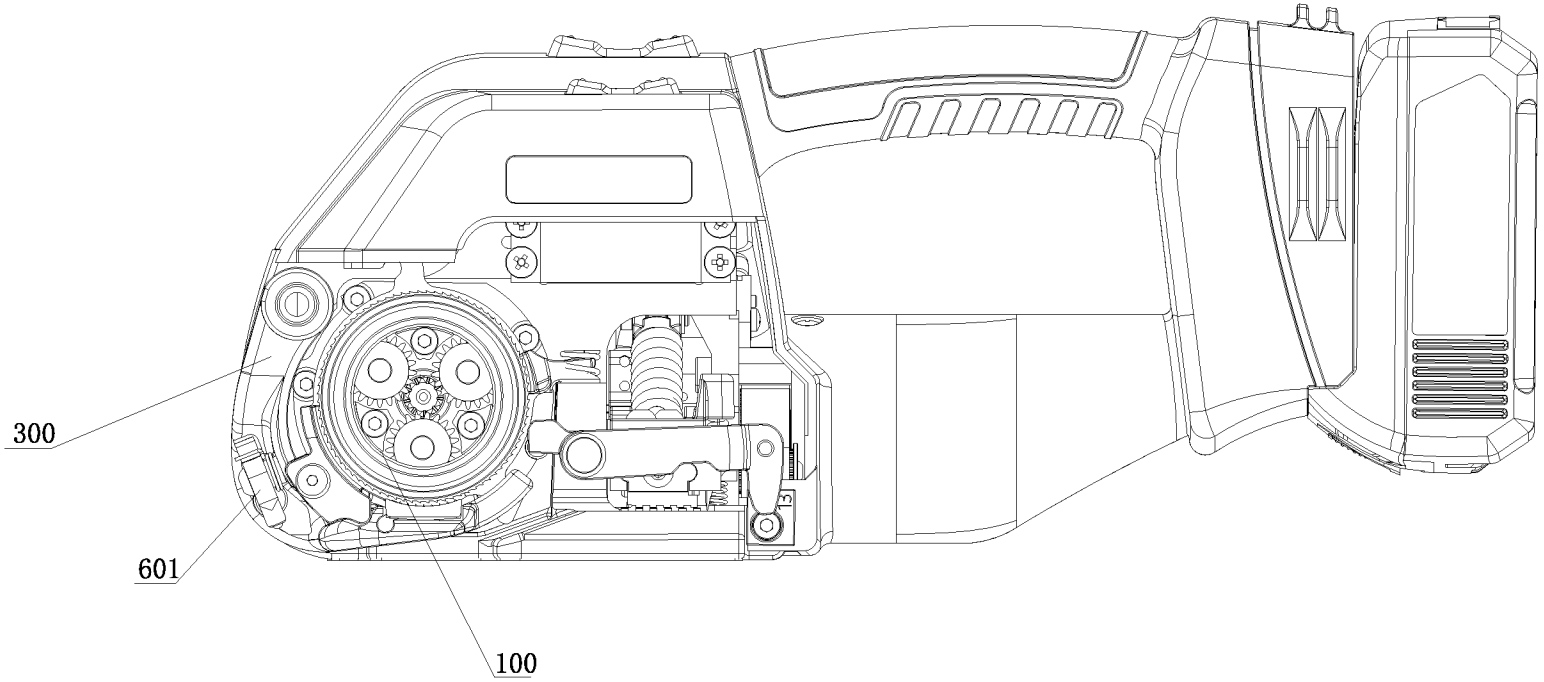
FIG. 7 is a schematic diagram of an embodiment of a handleless portable packaging machine applying a belt pressing mechanism of the present invention.
Figure 8:
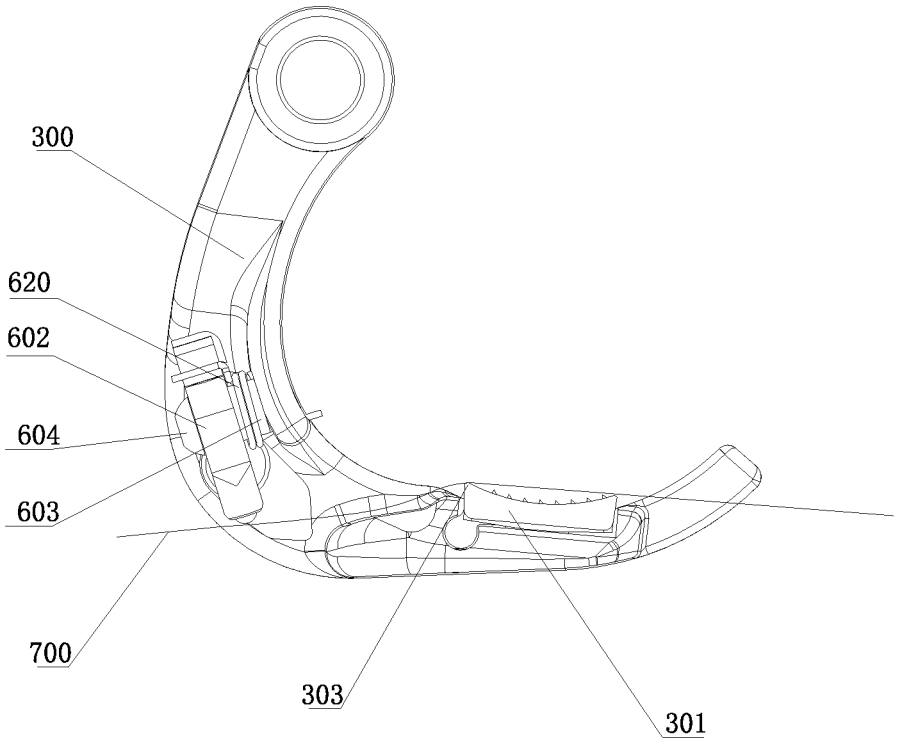
FIG. 8 is a front view of a swing arm provided with a belt pressing mechanism in the embodiment shown in FIG. 7.
Figure 9:
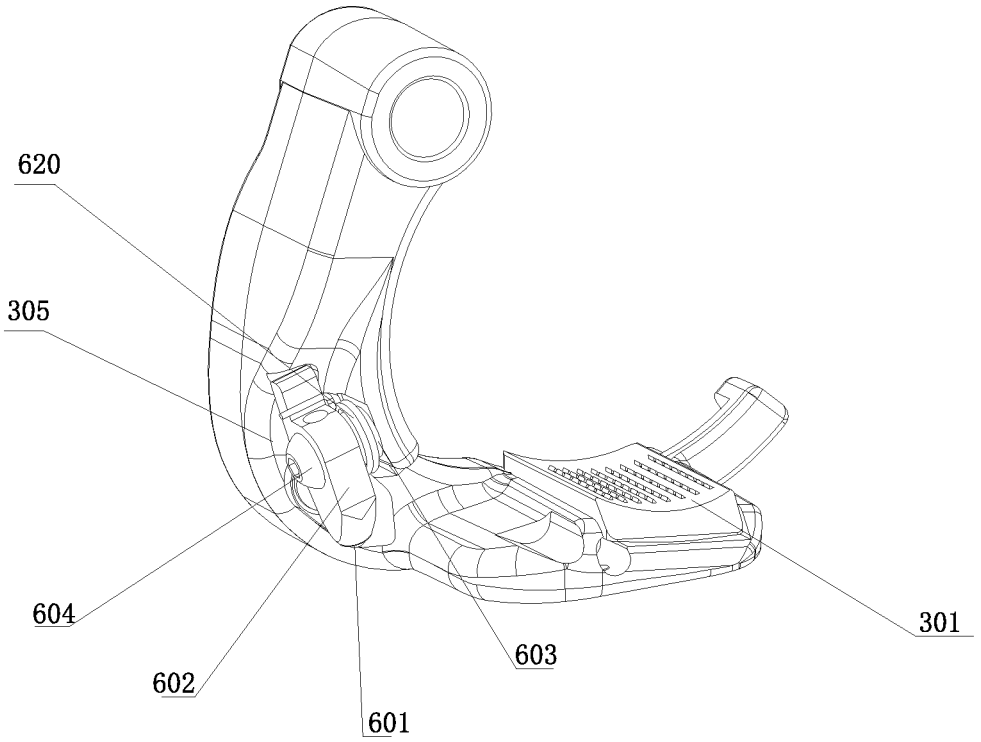
FIG. 9 is a perspective view of a swing arm provided with a belt pressing mechanism in the embodiment shown in FIG. 7.
Figure 10:
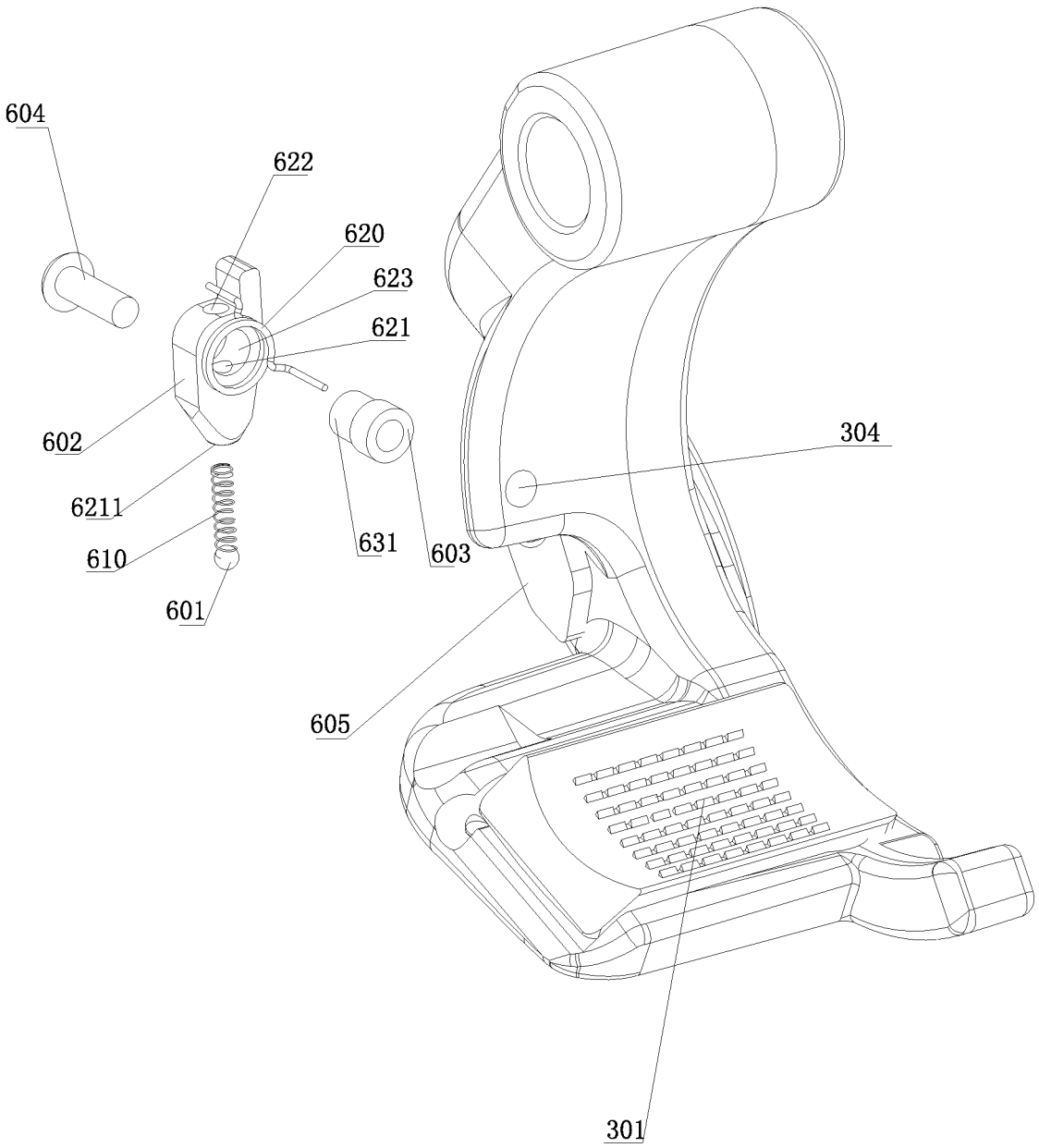
FIG. 10 is an exploded view of the structure shown in FIG. 9.

The following examples refer to FIGS. 7 to 10.

The belt pressing mechanism 601 provided in this embodiment is arranged on the rocker arm 300 of the portable packaging machine, and the reference numeral 100 is the tensioning wheel of the portable packaging machine. The rocker arm 300 is bent and is arranged around the tensioning wheel 100 on one side of the tensioning wheel 100, and the inner bottom of the rocker arm 300 is provided with a toothed plate 301, after the rocker arm 300 turns to close with the tensioning wheel 100, the toothed plate 301 matches the tensioning wheel 100, gets the packaging strip 300 stuck, and when the tensioning wheel 100 rotates, the packaging strip 700 is tightened to the right (based on the placement position of the portable packaging machine in FIG. 7).

The belt pressing mechanism comprises a first elastic mechanism and a belt pressing part, the first elastic mechanism adopts a compression spring 610, and the belt pressing part adopts a steel ball 601, which is convenient for installation and has a small frictional resistance to the packaging strip 700; the compression spring 610 pushes the steel ball 601 downward, and allows the steel ball 601 to retract and provides an elastic force for the steel ball 601 to return downward, and the height of the lower end of the steel ball 601 is lower than the upper end 303 of the toothed plate 301 arranged at the inner bottom of the rocker arm, which is close to the side of the belt pressing mechanism. When the curved rocker arm 300 and the tensioning wheel 100 are in an open state and the packing strip 700 is put in, the belt pressing part (steel ball 601) can press the packing belt 700 downward; when the rocker arm 300 is rotated in the closing direction, the state of the packing tape 700 can be effectively maintained and prevented from falling out.

The portable packaging machine is provided with a packaging strip limiting structure on the inner side of the rocker arm, which can ensure that the position of the packaging strip 700 in the width direction is appropriate when it is put in, and is convenient for the belt pressing part to play the role of pressing the strip. The packaging strip limiting structure can adopt a limiting block 605 or a limiting plate, etc.

The belt pressing mechanism is provided with a rotatable mounting block 602, and the rotation axis of the mounting block 602 is orthogonal to the rotation axis of the rocker arm 300. Through this rotation, the belt pressing part (steel ball 601) on the mounting block 602 changes in height. Through the rotation of the mounting block 602, the belt pressing part is adapted to the lifting of the packing belt when the belt is tightened at the vacated height, so that the pressing strip and the tightening strip of the portable packaging machine are more coordinated, which not only ensures the strip pressing effect, but also makes the process of tightening the belt smooth.

The mounting block 602 is provided with a mounting hole 621, the compression spring 610 and the steel ball 601 are provided in the mounting hole 621, and the lower end orifice 6211 of the mounting block 621 is smaller than the diameter of the steel ball 601.

The belt pressing mechanism is provided with a spacer 603 and a connecting screw 604, the spacer 603 has an insertion end 631, the mounting block 602 is provided with a connecting hole 623, the insertion end 631 is inserted into the connecting hole 623, and the screw 604 is connected to the rocker arm 300 through the connecting hole 623 and the spacer 603. The reference numeral 304 is the screw connecting hole on the swing arm that is matched with the screw 604; the mounting block 602 is provided with a hole orthogonally passing through the connecting hole 623, the lower part of the connecting hole is used as a mounting hole 621, the upper hole 622 is used as a via hole for mounting the compression spring 610 and the steel ball 601, and can be blocked with a plug. The insertion end 631 of the spacer serves as a rotation axis of the mounting block 602 and as a supporting part of the compression spring 610.

The mounting block 602 is connected to the second elastic mechanism, the second elastic mechanism adopts a torsion spring 620, and the torsion spring 620 is sleeved between the spacers 603 and connected between the rocker arm 300 and the mounting block 602.

A concave area 305 is provided on the outer side of the rocker arm 300, and the mounting block 601 is correspondingly disposed in the concave area 305, to facilitate the arrangement of the belt pressing part.

In this embodiment, the belt pressing mechanism is adopted, which can prevent the packaging strip from falling out to the outside through a certain degree of strip pressure when the swing arm and the tensioning wheel are closed, and when the packaging strip is stretched and the packaging strip is lifted up, elastic vacation is adaptive, which does not hinder the work of the tensioning strip, and facilitates the automatic operation of the portable packaging machine.

The description only describes the specific embodiments of the present invention, but the structural features of the present invention are not limited thereto. Any changes or modifications made by those skilled in the art within the field of the present invention shall fall within the scope of protection of the present invention.

It should be noted that the terms "comprising" and "having" in the description and claims of the present invention and the accompanying drawings, as well as any modifications thereof, are intended to cover non-exclusive inclusion. The terms "installed/mounted", "arranged", "set", "connected", "sleeved" should be construed broadly. For example, it may be a fixed connection, a detachable connection, or an integral structure; it may be a mechanical connection, or an electrical connection; it may be directly connected, or indirectly connected through an intermediary, or between two devices, elements, or internal communication between components. For those of ordinary skill in the art, the specific meanings of the above terms in the present invention can be understood according to specific situations.

It should be understood that, in the description of the present invention, the orientation or positional relationship indicated by the terms "one end", "another end", "outside", "inside", "horizontal", "end", "length", "outer end", "left", "right", etc. is based on the orientation or positional relationship shown in the figures, and is only for the convenience of describing the present invention and simplifying the description, rather than indicating or implying that the indicated device or element must have the particular orientation, construction and operation in the particular orientation, therefore, it cannot be construed as limitations of the present invention. The terms "first", "second" are used for brevity of description only, and do not indicate or imply relative importance.

Furthermore, variations to the disclosed embodiments can be understood and effected by those skilled in the art in practicing the claims of the invention, from a study of the drawings, the disclosure, and the appended claims. Furthermore, in the claims, words such as "comprising", "containing" and the like do not exclude other elements or steps, and non-plural nouns do not exclude their plurals.

The invention claimed is:

1. A tensioning mechanism, which is installed in a portable packaging machine, comprising a tensioning wheel, a tensioning wheel driving electric motor, a gear connecting mechanism arranged between the driving electric motor and the tensioning wheel, wherein the tensioning mechanism is provided with a rotation direction control and rotation angle keeping mechanism, a non-return mechanism and a rocker arm, the rotation direction control and rotation angle keeping mechanism being connected to the non-return mechanism and the rocker arm, and the rocker arm being provided with a toothed structure matching the tensioning wheel, by means of matching the rotation direction control and rotation angle keeping mechanism and a second reset mechanism, the rocker arm is driven to rotate, and an angle after the rocker arm rotates in place is kept, such that the toothed structure and the tensioning wheel are in a tensioned matching state or a loosened state; and by means of matching the rotation direction control and rotation angle keeping mechanism and a first reset mechanism, the non-return mechanism is driven to be in a non-return matching state or released from the non-return matching state, the gear connecting mechanism is connected to the non-return mechanism, and when the non-return mechanism is in the non-return matching state, the tensioning wheel is only driven to rotate in a single direction and cannot rotate reversely, and the single direction is a direction of rotation to tension a packaging strip.

2. The tensioning mechanism according to claim 1, wherein the rotation direction control and rotation angle keeping mechanism adopts a steering engine.

3. The tensioning mechanism according to claim 1, wherein the non-return mechanism comprises a non-return mechanism connecting gear, a ratchet coaxially connected with the non-return mechanism connecting gear and a pawl matching the ratchet, the pawl is driven by a first connecting gear by means of matching a first connecting structure and a first connecting gear, and the rocker arm is driven by a second connecting gear by means of matching a second connecting structure and a second connecting gear, and the rotation direction control and rotation angle keeping mechanism drives the first connecting gear and the second connecting gear.

4. The tensioning mechanism according to claim 3, wherein the first connecting gear and the second connecting gear are in mesh connection with rotate synchronously, the second connecting gear is larger than the first connecting gear, and the second connecting gear has a lower rotational speed than the first connecting gear.

5. The tensioning mechanism according to claim 3, wherein the first connecting structure comprises a first cam arranged on a first connecting gear shaft of the first connecting gear and a second cam arranged on a pawl arm of the pawl, the first cam matches with the second cam, and the pawl arm is connected with the first reset mechanism.

6. The tensioning mechanism according to claim 5, wherein the second connecting structure comprises a driving part driven by the second connecting gear and a rotating connecting part, the rotating connecting part is provided with an acted part matching the driving part, and the rotating connecting part is provided with a structure connected to the rocker arm.

7. The tensioning mechanism according to claim 6, wherein the rotating connecting part is provided with a part connected to the second reset mechanism.

8. The tensioning mechanism according to claim 6, wherein the rotating connecting part is in a shape of a ring, and a rotation center line of the rotating connecting part is collinear with a rotation center line of the tensioning wheel, and the gear connecting structure is provided with a planetary gear reduction mechanism, the rotating connecting part is mounted on the planetary gear reduction mechanism through a bearing.

9. The tensioning mechanism according to claim 5, wherein the pawl arm is mounted on a shaft of the second connecting gear and the pawl arm is rotated relative to the shaft of the second connecting gear, and the driving part and the shaft of the second connecting gear are fixedly connected or in a whole.

10. The tensioning mechanism according to claim 3, wherein the rotation direction control and rotation angle keeping mechanism adopts a steering engine and the steering engine and the tensioning wheel driving electric motor are arranged in parallel, the steering engine is located above a side of the tensioning wheel and the tensioning wheel driving electric motor; the steering engine is connected with the first connecting gear through a driving gear, and the first connecting gear is in mesh connection with the second connecting gear, and the second connecting gear is larger than the first connecting gear, and the second connecting gear has a lower rotational speed than the first connecting gear;

the pawl is connected with the first connecting gear through the first connecting structure, and the rocker arm is connected with the second connecting gear through the second connecting structure;

the second connecting structure comprises a driving part driven by the second connecting gear and a rotating connecting part, the rotating connecting part is provided with an acted part matching the driving part, and the rotating connecting part is provided with a structure connected to the rocker arm;

the rotating connecting part is in a shape of a ring, and a rotation center line of the rotating connecting part is collinear with a rotation center line of the tensioning wheel, and the gear connecting structure is provided with a planetary gear reduction mechanism, the rotating connecting part is mounted on the planetary gear reduction mechanism through a bearing, the tensioning wheel is provided with a ring gear, and a output gear coaxial with a sun gear of the planetary gear reduction mechanism is connected with the ring gear through a connecting gear;

the non-return mechanism is arranged in front of the planetary gear reduction mechanism;

the non-return mechanism connecting gear is mounted on a shaft of the ratchet through a one-way bearing, when the tensioning mechanism is tightening, the non-return mechanism is in a non-return matching state, in a corresponding tensioning rotation direction of the tensioning wheel, the one-way bearing allows the non-return mechanism connecting gear to rotate relative to the ratchet, and when the tensioning wheel driving electric motor stops rotating, the non-return mechanism connecting gear is prohibited from rotating relative to the ratchet in an opposite direction, and both of the non-return mechanism connecting and the ratchet must rotate together.

11. The tensioning mechanism according to claim 1, wherein a belt pressing mechanism is provided, and the belt pressing mechanism is arranged on the rocker arm, and the belt pressing mechanism comprises a first elastic mechanism and a belt pressing part, the first elastic mechanism pushes the belt pressing part downward, allows the belt pressing part to retract and provides an elastic force for the belt pressing part to return downward, and a height of a lower end of the belt pressing part is lower than an upper end of a toothed plate arranged at an inner bottom of the rocker arm, which the inner bottom of the rocker arm is close to a side of the belt pressing mechanism.

12. The tensioning mechanism according to claim 11, wherein the belt pressing part adopts a rolling element.

13. The tensioning mechanism according to claim 11, wherein the belt pressing mechanism is provided with a rotatable mounting block, the first elastic mechanism and the belt pressing part are arranged in the mounting block, through a rotation of the mounting block, the belt pressing part is adapted to a lifting of the packaging strip when the belt pressing part is tightened at a vacated height, and the mounting block is connected to a second elastic mechanism.

14. The tensioning mechanism according to claim 13, wherein the belt pressing mechanism is provided with a spacer and a connecting screw, the spacer is connected with the mounting block, and the connecting screw connects the mounting block with the rocker arm.

15. The tensioning mechanism according to claim 14, wherein the second elastic mechanism adopts a torsion spring, and the torsion spring is sleeved by the spacer and connected between the rocker arm and the mounting block.

16. The tensioning mechanism according to claim 14, wherein the first elastic mechanism adopts a compression spring, the mounting block is provided with a connecting hole, the spacer is provided with a part inserted into the connecting hole, and the connecting screw passes through the connecting hole and the spacer to connect with the rocker arm; the mounting block is provided with a hole orthogonally passing through the connecting hole, a lower part of the connecting hole is used as a mounting hole, the belt pressing part adopts a steel ball, the compression spring and the steel ball are arranged in the mounting hole, a lower end orifice of the mounting hole is smaller than a diameter of the steel ball, and an inserting part of the spacer serves as a supporting part of the compression spring.

17. The tensioning mechanism according to claim 16, wherein the spacer is provided with a portion inserted into a connecting hole and serves as a rotation axis of the mounting block.

18. The tensioning mechanism according to claim 13, wherein the first elastic mechanism adopts a compression spring, the mounting block is provided with a mounting hole inside, the belt pressing part adopts a steel ball, the compression spring and the steel ball are arranged in the mounting hole, and a lower end orifice of the mounting hole is smaller than a diameter of the steel ball.

19. The tensioning mechanism according to claim 13, wherein a concave area is provided on an outer side of the rocker arm, and the mounting block is correspondingly disposed in the concave area.

* * * * *